US005131452A

United States Patent [19]

Bilz et al.

[11] Patent Number: 5,131,452

[45] Date of Patent: Jul. 21, 1992

[54] METHOD AND APPARATUS FOR THE DOSED REMOVAL MOLTEN METAL OUT OF A MELT VESSEL

[75] Inventors: Georg Bilz, Nuremberg; Hans Lammermann; Wilhelm Hertlein, both of Schwabach; Winfried Grabietz, Nuremberg, all of Fed. Rep. of Germany

[73] Assignee: Alcan Deutschland GmbH, Gottingen, Fed. Rep. of Germany

[21] Appl. No.: 569,948

[22] Filed: Aug. 20, 1990

[30] Foreign Application Priority Data

Aug. 23, 1989 [DE] Fed. Rep. of Germany ..... 3927852

[51] Int. Cl.[5] ..... B22D 39/00; B22D 41/04

[52] U.S. Cl. ..... 164/136; 164/336; 222/590; 222/629

[58] Field of Search ..... 164/133, 136, 335, 336, 164/337; 222/604, 605, 629, 590, 591

[56] References Cited

U.S. PATENT DOCUMENTS

| | | | |
|---|---|---|---|
| 2,064,734 | 12/1936 | Crawford | 164/336 X |
| 3,774,815 | 11/1973 | McCarthy | 164/336 X |
| 4,078,707 | 3/1978 | Ishikawa | 164/336 X |
| 4,155,400 | 5/1979 | Rosin et al. | 222/604 X |
| 4,353,406 | 10/1982 | Gaddi | 164/336 |

*Primary Examiner*—J. Reed Batten, Jr.
*Attorney, Agent, or Firm*—Cooper & Dunham

[57] ABSTRACT

The volume of melt within the ladle dipper is maintained essentially unchanged in its position relative to the volume of melt remaining in the holding crucible during the ladling operation in order to avoid undesirable turbulence and the formation of foam in the melt.

20 Claims, 1 Drawing Sheet

METHOD AND APPARATUS FOR THE DOSED REMOVAL MOLTEN METAL OUT OF A MELT VESSEL

Figure 1:
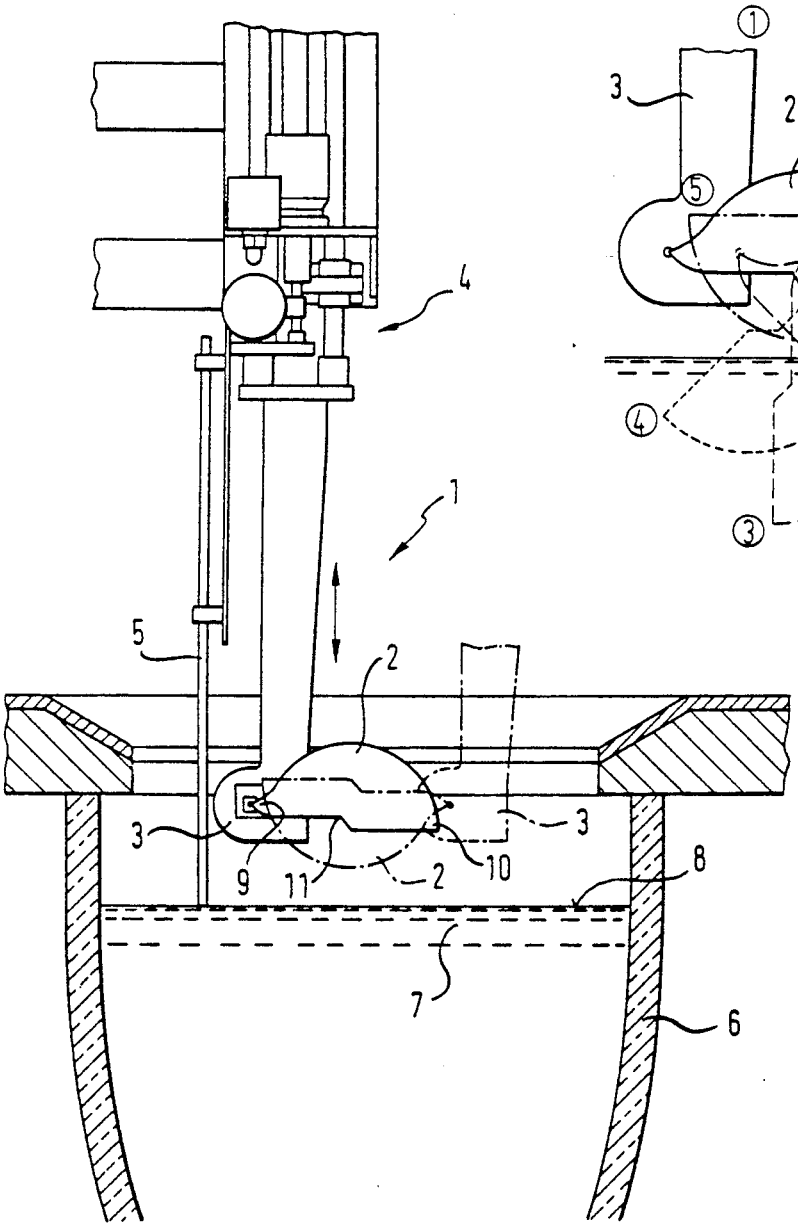

The invention relates to a method and an apparatus for the dosed removal of various volumes of molten metal from a melt container having a fluctuating bath level and for the transport of the metal to a casting apparatus by means of a ladle dipper open on one side.

In metal foundries, to cast ingot molds, a relatively exactly dosed volume of molten metal must be removed from a holding crucible for every casting, transported to the ingot mold and emptied with a certain rate of pouring into the pouring gate.

In the traditional method applied up to now, the removal and pouring is conducted by hand by means of a ladle or pouring cup. The foundryman dips the ladle fixed to the end of a handle bar into the melt and turns the ladle under the bath level in such a manner that a certain volume of metal is scooped out of the melt on account of the depth of immersion. Subsequently, the foundryman lifts the ladle out of the bath with the opening in the horizontal position, carries this to the ingot mold and there empties this over the pouring nozzle by tilting the ladle. This traditional method requires heavy manual labour and is dependent on the skill and the precise method of operation of the foundryman. As the volume required per working step cannot be dosed with the required accuracy according to quantity during the ladling step, as a rule, the foundryman removes a greater volume and pours the quantity remaining in the ladle back into the melt bath after filling the ingot mold. This procedure leads to turbulence and the formation of foam in the melt in the holding crucible during the pouring from the ladle.

In order to relieve, the foundryman of this heavy manual labour and to avoid the negative influences dependent upon the skill and method of operation of the foundryman, automatic dosing and pouring devices have already been developed. As a rule, these devices operate in such a manner that a ladle dipper is supported by a mechanism in a rotatable, tiltable and transportable manner so that the ladle dipper can be moved to-and-fro and swung between one or more holding crucibles and mostly several ingot molds.

A method and apparatus for dosed removal of various volumes of molten metal from a holding crucible appears to be described in DE-OS 28 04 381. A ladle dipper is moved out of a defined waiting position over the bath level and is dipped with the ladle bottom in the forward position to a defined depth in the melt to take up the volume of melt complete process being carried art with the aud of probes. The melt then flows over the ladle rim into the hollow space of the ladle, whereby turbulence occurs. As soon as the hollow space of the ladle is filled, the ladle dipper is then lifted out of the melt and held in a precisely preset inclined position over the bath surface for a short period of time. The superfluous melt flows waterfall-like over the ladle rim back into the melt in the holding crucible until the desired volume remains, turbulence again being caused and foam being generated.

It is also disadvantageous that the described ladling and dosing operation takes a relatively large period of time, as the flowing of the melt into the ladle dipper and the subsequent outflow when the ladle is raised out of the melt must be conducted relatively slowly in order to at least prevent the turbulence and formation of foam as much as possible.

However, it has been shown in practice that despite all care and even with the slow progression of the manner of operation described, turbulence and the formation of foam cannot be prevented in the bath surface area.

Further known developments in this field (DE-PS 30 17 807 DE-OS 30 34 913 DE-PS 34 12 126, DE-0S 34 20 415, EP-PS 01 29 270 and U.S. Pat. No. 4 558 421) concern themselves with details of the ladle dipper, as for example the provision of so-called foam-catching-pockets, or the further development of the drive and control devices. However, these known apparatus basically also operate according to the principle described above so that these also have the disclosed disadvantages relating to the turbulence and the formation of foam.

It is an object of the present invention to further develop a method and a device respectively of the type indicated which practically completely prevents turbulence and the formation of foam in the ladle dipper as well as on the surface of the metal bath during a rapid procedure.

This object is solved in accordance with the present invention in that each volume of the melt within the ladling dipper is held still and unchanged in its position relative to the melt remaining in the holding crucible during the filling operation. In other words, the object set is solved in accordance with the invention in that the ladle dipper is moved out of a defined stationary position immediately above the surface of the bath with its open side facing the bath in such a manner that it conducts a purely rotational movement of 180° about a virtual or an actual stationary axis with respect to the bath which extends through the central plane of the ladle, the ladle dipper penetrating into the bath approximately perpendicularly with one side of the rim of its opening and rotating in the bath without a horizontal displacement so that it stands in the bath filled with melt with its opening facing upwards at the end of the rotational movement, from which position it is raised by moving its mounting and subsequently transported to the pouring location. This manner of ladling ensures that despite the unavoidable submersion of the ladle to remove the volume of metal practically no horizontal component of movement is transmitted to the melt so that the melt in the holding crucible is still even during the removal operation and is not disturbed by turbulent flows of metal. On account of the inventive manner of operation, only two practically still volumes of metal separated from one another are formed by the walls of the ladle dipper in the holding crucible and the still volume in the hollow space of the ladle is removed out of the volume remaining in the holding crucible without any relevant turbulence. In fact, on account of the inventive submerging of the ladle and its rotational movement, the oxide skin present on the surface of the bath is scooped up by the rim of the ladle without turbulence and held in the hollow space of the ladle.

Furthermore, dripping arising after the raising of the ladle dipper out of the melt is virtually eliminated, whereby the undesireable formation of foam is particularly avoided.

The formation of foam is also substantially eliminated in the ladling operation, as the melt is hardly moved during the scooping of the desired volume.

In accordance with the method of the present invention, the advantage results that swirling of the melt is avoided as the ladle dipper is not submerged into the melt with its closed side pointed vertically downwards, as is the case for the known method previously described herein.

Furthermore, the definition of a stationary position enables the simplified setting of the dosing quantity, as this is determined by the height of the stationary position above the surface of the bath for a predetermined ladle size and can be maintained exactly for each ladling operation.

If the ladle dipper is pivotable about a horizontal axis extending through its pouring nozzle, in moving the ladle mounting a horizontal distance during the ladling operation, the advantage results that even for this kind of construction, the part of the ladling dipper which is submerged in the bath conducts a purely rotational movement relative to the bath and experiences practically no linear horizontal component of movement so that the undesired movement or stirring of the metallic melt is avoided.

This further leads to the fact that the ladling dipper can be returned back into an upside down position after the emptying into the ingot mold so that the adhering oxide skin remaining in the ladling dipper can fall out, which action is simplified in that the ladling dipper does not require any so-called foam-catching-pockets and has no edges and corners to which the oxide skin can attach itself. In other words, this means that the cleaning of the ladle dipper can result easily by turning it upside down.

Figure 2:
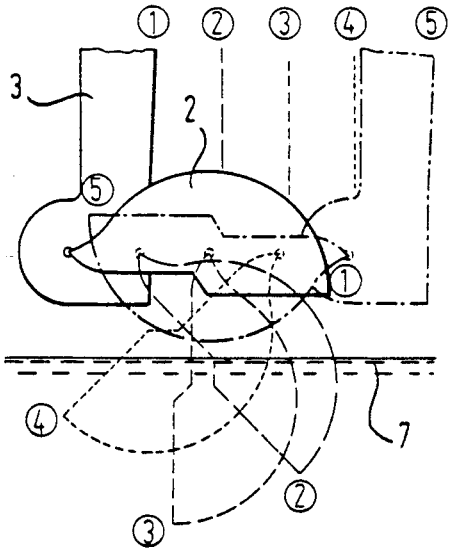

For the purpose of further explanation and for the better understanding of the invention, an exemplified embodiment of a device and a schematic description of the operating sequence of the method is more closely described and explained with reference to the accompanying drawings in the following, in which:

FIG. 1 shows a schematic representation of an apparatus according to the invention, FIG. 2 shows a representation corresponding to FIG. 1 of the operating sequence of the ladling operation according to the inventive method.

FIG. 1 shows an inventive apparatus 1 having a ladle dipper 2 which is pivotally supported via a mounting 3 on a ladle mechanism 4. The ladle mechanism 4 may comprise a hydraulic, pneumatic or electric drive constructed in a usual manner on conventional running gear and further comprises a control device not shown in detail in FIG. 1 for controlling all movements about all space axes as well as the rotational and pivotal movements of the ladling dipper 2.

The inventive apparatus 1 further includes a probe 5 which is mounted on the ladle mechanism 4 and interacts upon the emission of a signal with the control device or an impulse generator of the same when coming into contact with the bath surface.

FIG. 1 further shows a holding crucible 6 containing a metallic melt 7. The bath surface supporting an oxide skin has the reference numeral 8. The holding crucible 6 can be constructed in the usual manner.

In the embodiment shown in FIG. 1, the ladle dipper 2 is rotatably supported on the mounting 3 about its pouring nozzle 9. FIG. 1 shows the stationary position of the ladle dipper 2 in solid lines into which it is slowly moved after taking up an initial intermediate position. The lowering of the ladle dipper 2 into the intermediate position results at high speed until the ladle dipper has been moved into the holding crucible 6 to such an extent that the probe 5 contacts the bath surface 8 and thus emits a signal through which an impulse generator not shown activates the drive and control device which controls the further lowering of the ladle dipper at a slow speed up to the exactly predetermined position over the bath surface 8 shown in FIG. 1 and stops it there.

The ladle dipper 2 is tilted about its pouring nozzle 9 out of this position in the shown embodiment of the inventive device 1 such that it penetrates the melt 7 with the rim 10 which lies opposite the pouring nozzle 9. The ladle dipper 2 is simultaneously moved horizontally together with its mounting 3 in such a manner that the portion of the ladle dipper 2 submerged in the melt is subjected to practically no linear horizontal component of movement relative to the melt. In other words, the ladle dipper 2 acts during the pivot movement as if its axis of rotation is located approximately at the level of the bath surface and extends through the central plane of the ladle dipper.

The sequence of movement of the ladle dipper 2 during its submersion into the melt 7 is directly apparent in the depiction in FIG. 2, which shows the individual tilt positions 1 to 5 of the ladle dipper 2 and the corresponding horizontal positions 1 to 5 of the mounting 3. After the ladle dipper 2 has conducted its rotational scooping movement, it surfaces again out of the melt 7 with its opening 11 facing upwards at the end of the scooping movement. This position is indicated in FIG. 1 by the dash-dot lines of the ladle dipper 2 and the mounting 3. It can be further seen from this depiction that the mounting 3 has passed through a horizontal path of movement, the length of which corresponds approximately to the diameter of the ladle dipper.

The ladle dipper 2 can be moved to an ingot mold and emptied there in the usual manner from the end position mentioned above, in which position the ladle dipper has already removed the desired volume from the holding crucible 6.

In order to clean the ladle dipper 2, this is rotated again into the upside-down position, shown in solid lines in FIG. 1, in which position the adherent oxide skin remaining in the ladle dipper 2 can fall out of the ladle dipper, as this does not have any edges or corners to which the oxide skin can attach itself. The cleaning of the ladle dipper thus results in a simple and cost effective manner by means of the revealed rotation into the upside-down position.

In addition, the ladle drive means can be a rotational drive which may be run in both rotational directions without any limitation on the rotational angle.

In accordance with the embodiment shown in FIG. 1, the ladling rim 10 can be formed by the rim of the ladle dipper 2 lying opposite the pouring nozzle 9. With this, the pouring nozzle 9 is formed in such a manner that an emptying which is as still as possible is achieved when tilting the ladle dipper about the horizontal axis.

However, it is possible in principle to effect the arrangement in such a manner that the ladling rim 10 and the pouring nozzle 9 are formed by one and the same rim if the mounting of the ladle is moved in a suitable manner during the pouring operation.

The pouring speed can be regulated in accordance with a preset programme corresponding to the requirements for the ingot mold in the course of the casting operation.

The transfer movement of the ladle mounting can ensue in such a manner that several ingot molds and/or crucibles are approached in alternation. Although the support of the ladle dipper 2 ensues via a horizontal axis located in the region of the nozzle 9 in the embodiment of the apparatus 1 shown in FIG. 1, it is generally also possible to arrange the ladle dipper 2 in the form of a spherical segment which is rotatable about a horizontal swivel axis spanning the centre of the sphere. In this case, the horizontal transfer movement of the ladle dipper mounting is advantageously eliminated without undesirable turbulence arising in the melt.

We claim:

1. Method for the dosed removal of various volumes of molten metal from a holding crucible having a fluctuating bath level and for the transport of the molten metal to a casting apparatus by means of a ladle dipper open on one side, wherein the molten metal enters into the ladle dipper over a rim of the ladle dipper upon submergence thereof into the molten metal and is poured out of the ladle dipper over a pouring nozzle thereof into the casting apparatus upon tilting of the ladle dipper about a horizontal axis, the method to fill the casting apparatus comprising the steps of: transporting the ladle dipper to the holding crucible by means of a ladling mechanism; bringing the ladle dipper from this position into a waiting position at a defined height above the bath level by lowering the ladle dipper; submerging the ladle dipper into the molten metal in response to a signal and filling the ladle dipper over the rim thereof with a certain volume of molten metal; and moving the ladle dipper in a horizontal position back to the casting apparatus and pouring this volume in this position over the pouring nozzle into the casting apparatus by tilting the ladle dipper, wherein each volume of molten metal in the ladle dipper is maintained essentially still and unchanged in its position relative to the molten metal remaining in the holding crucible during the filling operation.

2. Method according to claim 1, wherein the ladle dipper is tilted out of a stationary position above the bath level in such a manner that it penetrates into the molten metal with the ladle rim essentially perpendicular to the bath level.

3. Method according to claim 2, wherein the ladle dipper is pivoted about an axis extending approximately horizontally in the region of the pouring nozzle.

4. Method according to claim 3, wherein the ladle dipper is moved horizontally together with its mounting in such a manner during the tilting that the part of the ladle dipper submerged in the bath conducts a rotational movement about a virtual axis fixed relative to the bath extending through a plane central to the ladle dipper and thereby experiences essentially no linear horizontal component of movement relative to the bath.

5. Method according to claim 4, wherein the ladle dipper is moved into the stationary position with its opening facing downwards.

6. Method according to claim 5, wherein the ladle dipper is moved at high speed into an intermediate position over the bath level.

7. Method according to claim 6, wherein the ladle dipper is slowly lowered from the intermediate position into the stationary position, the stationary position being determined by a probe making contact with the bath level.

8. Method according to claim 7, wherein the lowering into the stationary position is conducted by means of an impulse generator.

9. Method according to claim 8, wherein the ladle dipper is pivoted about 180°, starting from the stationary position.

10. Method according to claim 9, wherein the volume of molten metal to be removed for a given ladle dipper size is set by the height of the stationary position above the bath level.

11. Method according to claim 10, wherein the mounting of the ladle dipper is moved along a horizontal path of movement corresponding to the diameter of the ladle dipper during the ladling operation.

12. Method according to claim 11, wherein an oxide skin located on the bath level is scooped up during the filling of the ladle dipper without turbulence and taken up by the opening of the ladle dipper.

13. Apparatus for the dosed removal of various volumes of molten metal from a holding crucible having a fluctuating bath level and for transporting the removed volume of molten metal to a casting apparatus, comprising:

a ladle dipper open on one side which is rotatable about a ladle mounting arranged on a ladle mechanism which is moveable about all space axes, and a drive and control device for operating the ladle mechanism and for pivoting the ladle dipper, wherein the ladle dipper is lowerable into and moveable out of the melt by the drive and control device in such a manner that the volume of molten metal to be removed and the volume of molten metal remaining in the holding crucible are essentially maintained free of any horizontal movement during the filling of the ladle dipper.

14. Apparatus according to claim 13, wherein the ladle dipper is supported to be pivotable about an axis arranged in the region of its pouring nozzle.

15. Apparatus according to claim 14, wherein the ladle dipper can be pivoted out of an upside-down position above the bath level by the drive and control device for removing the molten metal, the ladle mounting simultaneously being moveable horizontally through a distance corresponding to the diameter of the ladle dipper.

16. Apparatus according to claim 13, wherein the drive and control device has a ladle drive which is a purely rotational drive.

17. Apparatus according to claim 16, wherein the rotational drive can be operated in both rotational directions.

18. Apparatus according to claim 13, wherein a ladling rim is arranged at the rim of the ladle dipper lying opposite the pouring nozzle.

19. Apparatus according to claim 13, wherein a ladling rim and pouring nozzle are formed by a same rim of the ladle dipper.

20. Apparatus according to claim 13, wherein the drive and control device comprises hydraulically, pneumatically or electrically controlled drives.

* * * * *